US009490576B2

(12) United States Patent
Plazio et al.

(10) Patent No.: US 9,490,576 B2
(45) Date of Patent: Nov. 8, 2016

(54) ELECTRICAL CONNECTOR WITH CONNECTOR POSITION ASSURANCE ELEMENT

(71) Applicant: Tyco Electronics AMP Italia S.R.L., Collegno (IT)

(72) Inventors: Adriano Plazio, Vinovo (IT); Fulvio Amerio, Turin (IT)

(73) Assignee: Tyco Electronics AMP Italia S.R.L., Collegno (IT)

( * ) Notice: Subject to any disclaimer, the term of this patent is extended or adjusted under 35 U.S.C. 154(b) by 0 days.

(21) Appl. No.: 14/688,416

(22) Filed: Apr. 16, 2015

(65) Prior Publication Data

US 2015/0222055 A1 Aug. 6, 2015

Related U.S. Application Data

(63) Continuation of application No. PCT/EP2013/070783, filed on Oct. 7, 2013.

(30) Foreign Application Priority Data

Oct. 16, 2012 (IT) ..... TO2012A0904

(51) Int. Cl.
*H01R 13/625* (2006.01)
*H01R 4/50* (2006.01)
(Continued)

(52) U.S. Cl.
CPC ..... *H01R 13/639* (2013.01); *H01R 13/641* (2013.01)

(58) Field of Classification Search
CPC ..... H01R 13/639; H01R 13/641
USPC ..... 439/347, 352, 489
See application file for complete search history.

(56) References Cited

U.S. PATENT DOCUMENTS 7,399,195 B2 * 7/2008 Kim ..... H01R 13/641 439/352
7,591,668 B2 * 9/2009 Nakamura ..... H01R 13/641 439/489
(Continued)

FOREIGN PATENT DOCUMENTS

| | | |
|---|---|---|
| EP | 1703599 A1 | 9/2006 |
| WO | 2011069610 A1 | 6/2011 |
| WO | 2011069611 A1 | 6/2011 |

OTHER PUBLICATIONS

PCT International Search Report and Written Opinion of the International Searching Authority, International Application No. PCT/EP2013/070783, dated Nov. 12, 2013, 8 pages.
(Continued)

*Primary Examiner* — Javaid Nasri
(74) *Attorney, Agent, or Firm* — Barley Snyder

(57) ABSTRACT

An electrical connector is disclosed having a first connector member, a second connector member, and a connector position assurance element. The first connector member has a stop surface with flanking projections. The second connector member is complimentary to the first connector member and has a stop element with a second raised portion. The connector position assurance element is slidably mountable on the first connector member and has a first engagement portion and a second engagement portion. The first engagement portion engages the flanking projections when the first connector member is completely mated to the second connector member in a final mating position. The second engagement portion is spaced a distance from the first engagement portion in a longitudinal direction of the connector position assurance element, and is engaged with the second raised portion when the first connector member is mated to the second connector member in the final mating position.

23 Claims, 20 Drawing Sheets

(51) Int. Cl.
*H01R 13/639* (2006.01)
*H01R 13/641* (2006.01)

(56) References Cited

U.S. PATENT DOCUMENTS 8,016,606 B1 9/2011 Kwan et al.
2008/0139035 A1 6/2008 Kim et al.
2009/0035980 A1 2/2009 Nakamura

OTHER PUBLICATIONS

English translation of the Chinese First Office Action, dated Jul. 5, 2016, 9 pages.

* cited by examiner

ELECTRICAL CONNECTOR WITH CONNECTOR POSITION ASSURANCE ELEMENT

CROSS-REFERENCE TO RELATED APPLICATION

This application is a continuation of International Patent Application No. PCT/EP2013/070783, filed Oct. 7, 2013, which claims priority under 35 U.S.C. §119 to TO2012A000904 filed Oct. 16, 2012.

FIELD OF THE INVENTION

The invention is generally related to an electrical connector, and, more specifically to an electrical connector having a connector position assurance element.

BACKGROUND

A connector position assurance ("CPA") element is slidably mountable on a first connector member 1, having a first, preliminary mounting position on the first connector member. In the preliminary mounting position, the connector position assurance element is prevented from being inserted into a CPA mounting element on the first connector member because a stop surface of the first connector member prevents the insertion if a corresponding second connector member has not yet been fully coupled to the first connector member. The connector position assurance element further has a second, final mating position, which is reachable only after complete coupling of the first and second connector members. Once complete coupling has been achieved, the connector position assurance element is permitted to pass the first stop surface to engage a stop element of the second connector member in the final mating position.

FIG. 1(*a*) shows a conventional first connector member 1 without the conventional connector position assurance element 3. In FIG. 1(*b*), the conventional COA element 3 is shown in the preliminary mounting position. FIGS. 1(*c*) and 1(*d*) show the conventional CPA element 3, from above and below respectively.

As shown in FIG. 2 without the CPA element 3, a CPA element receiving member is positioned on the first connector member 1, being able to flex with respect to the rest of the body of the first connector member 1.

As shown in FIG. 3, when the conventional CPA element 3 is in the preliminary mounting position, the conventional CPA element 3 is prevented from advancing further into the CPA element receiving member because an end portion 3*a* thereof engages with a stop surface 1*a* of the receiving portion of the first connector member 1. This engagement is due to a second connector member 2 not yet being fully coupled within the first connector member 1.

FIG. 4 indicates the direction D of coupling of the two connector members 1 and 2, and further shows the stop element 2*a* disposed on an outer surface of the second connector member 2. This stop element 2*a* has a ramp with an inclined plane that facilitates the displacement of the end portion 3*a* of the conventional CPA element 3, as well as the stop surface 1*a* of the first connector member 1. (See FIGS. 5 and 6) As the second connector member 2 advances within the first connector member 1 (see FIGS. 7 and 8), the stop element 2*a* is displaced under the stop surface 1*a* of the first connector member 1 and under the end portion 3*a* of the conventional CPA element 3.

As shown FIGS. 9 and 10, an intermediate mating phase is where the second connector member 2 is inserted into the first connector member 1, just before the conventional CPA element 3 is released from engagement with the stop surface 1*a*.

In FIGS. 11 and 12, the mating of first and second connector members (1,2) is complete. The stop surface 1*a* has advanced beyond the stop element 2*a*, and has been displaced downward behind the stop element 2*a* to form a latching connection. Additionally, the end portion 3*a* of the conventional CPA element 3 has be displace to an outermost portion of the ramp-like stop element 2*a*, and is free to be further displaced into a second, final mating position, by the mating direction arrow I in FIG. 12.

In the final mating state shown in FIG. 13, the end portion 3*a* of the CPA element 3 has been displaced beyond the stop element 2*a* of the second connector member 2. FIG. 13 also shows that the CPA element cannot be returned to the preliminary mounting position, since the mating surface 3*b* is engaged on the mating surface 1*b* of the body of the first connector member 1. To release these portions, a tab on the body of the first connector member 1 must be pulled (in the direction of the arrow R), allowing the surface 1*b* to be lowered and the CPA element 3 to be released and returned to the intermediate mating phase where the end portion 3*a* is in a raised position, i.e. the position prior to the final mating position.

The conventional CPA element 3 also includes a grasping member 3*c*, on which an operator acts to activate the CPA element 3 and to bring it from the first, preliminary mounting position into the second, final mating position.

While the conventional CPA element 3 performs the connector position assurance function, it requires a large insertion force by the operator to displace the convention CPA element 3 from the preliminary mounting position to the final mating position.

SUMMARY

It is an object of the invention, among others, to overcome or alleviate at least one aspect of the above mentioned disadvantages.

An electrical connector has a first connector member, a second connector member, and a connector position assurance element. The first connector member has a stop surface with flanking projections. The second connector member is complimentary to the first connector member and has a stop element with a second raised portion. The connector position assurance element is slidably mountable on the first connector member and has a first engagement portion and a second engagement portion. The first engagement portion engages the flanking projections when the first connector member is completely mated to the second connector member in a final mating position. The second engagement portion is spaced a distance from the first engagement portion in a longitudinal direction of the connector position assurance element, and is engaged with the second raised portion when the first connector member is mated to the second connector member in the final mating position.

BRIEF DESCRIPTION OF THE DRAWINGS

The invention will now be described by way of example, with reference to the accompanying Figures, of which:

FIG. 1(*b*) is a perspective view of the first connector member having a conventional connector position assurance element in a preliminary mounting position;

FIG. 1(*c*) is perspective view of a top side of the conventional connector position assurance element;

FIG. 1(*d*) is perspective view of a bottom side of the conventional connector position assurance element;

FIG. 18(*b*) is a perspective view of a bottom side of the first connector position assurance element;

FIG. 19(*b*) is a perspective view of a side of the CPA receiving member of the first connector member;

FIG. 19(*c*) is a perspective view of a bottom side of the CPA receiving member of the first connector member;

FIG. 20(*b*) is a cross-sectional view of the first connector member mated to the second connector member, with the first connector position assurance element in the final mating position;

FIG. 21(*b*) is an enlarged perspective view of FIG. 21(*a*) of the first connector member with the first connector position assurance element;

FIG. 22(*b*) is an enlarged cross-sectional view of FIG. 22(*a*) where the first connector member is separated from the second connector member, with the first connector position assurance element being in a preliminary mating position;

DETAILED DESCRIPTION OF THE EMBODIMENT(S)

The following description illustrates various specific details aimed at a thorough understanding of the embodiments. The embodiments can be produced without one or more specific details, or with other methods, components, materials, etc. In other cases, known structures, structural details, materials or operations are not illustrated or described in detail, since they can be produced in any known manner and also since they do not, taken in isolation, come under the scope of the present invention.

Figure 1A:
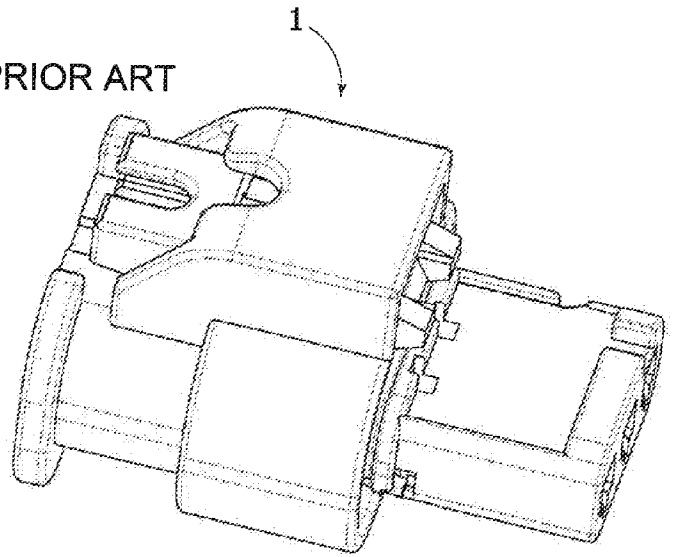
FIG. 1a PRIOR ART
FIG. 1(*a*) is a perspective view of a first connector member.
Figure 1C:
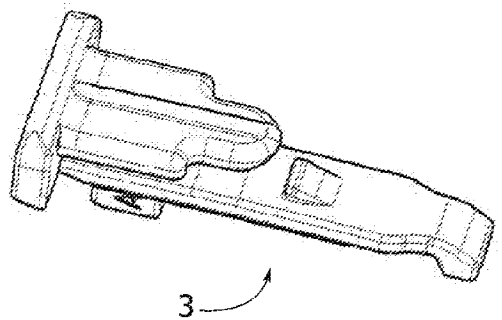
FIG. 1c PRIOR ART
Figure 1B:
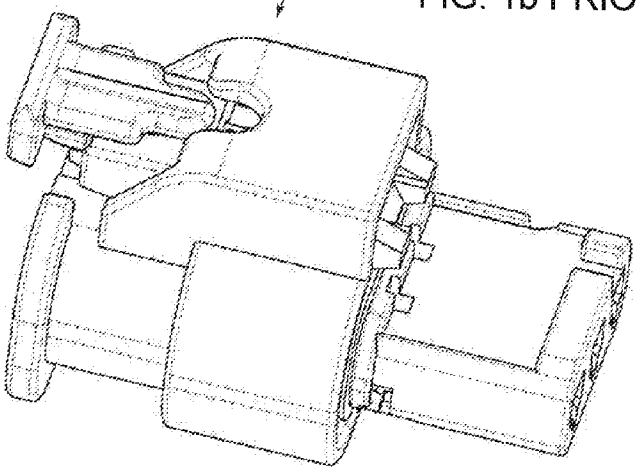
FIG. 1b PRIOR ART
Figure 1D:
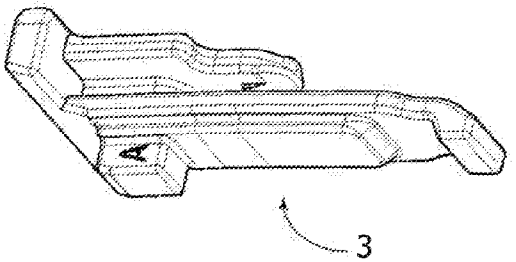
FIG. 1d PRIOR ART
Figure 2:
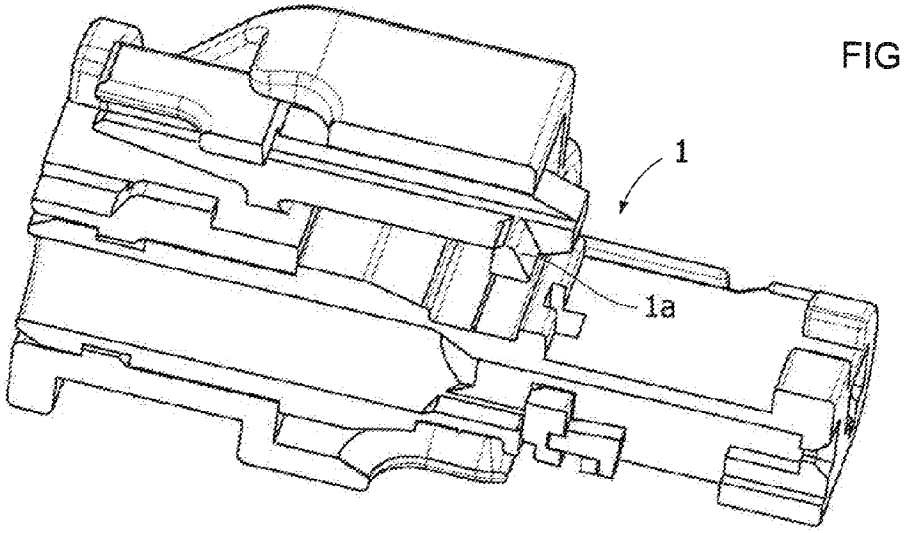
FIG. 2 PRIOR ART
FIG. 2 is a cross-sectional view of the first connection member without the conventional connector position assurance element.
Figure 3:
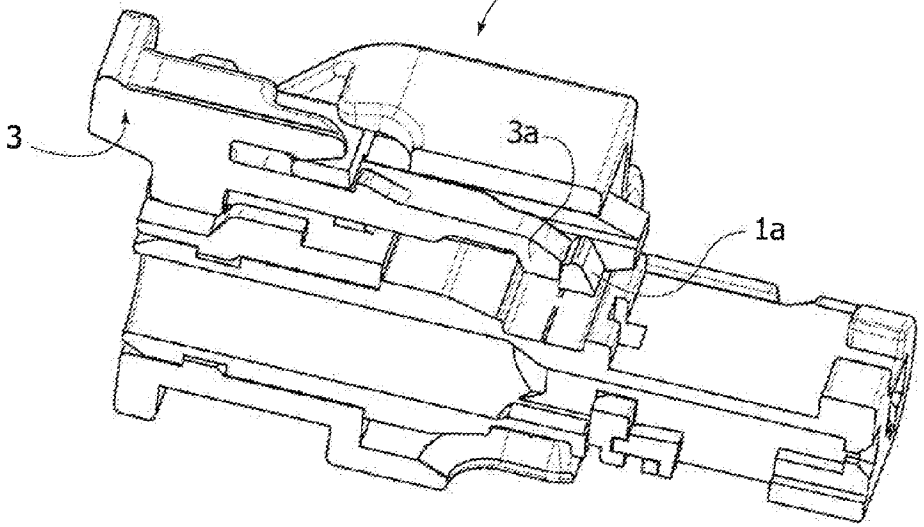
FIG. 3 PRIOR ART
FIG. 3 is a cross-sectional view of the first connection member in the preliminary mounting position.
Figure 5:
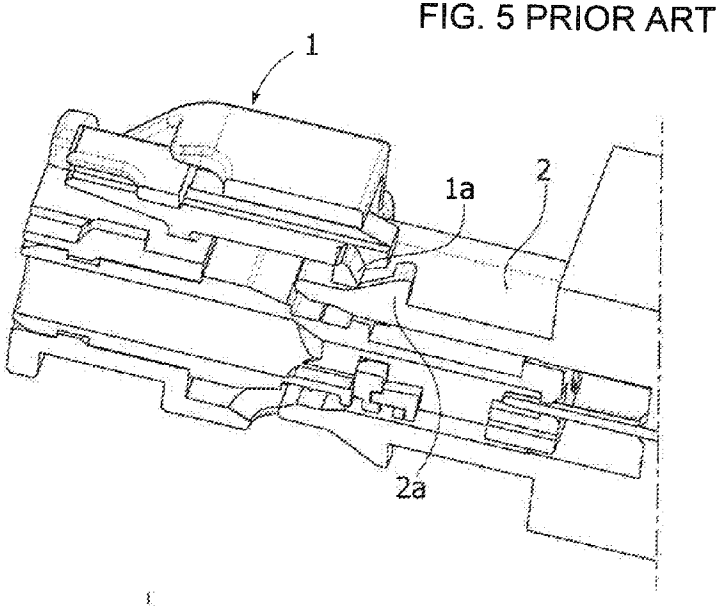
FIG. 5 PRIOR ART
FIG. 5 is a cross-sectional view of the first connection member and second connector member of FIG. 4.
Figure 4:
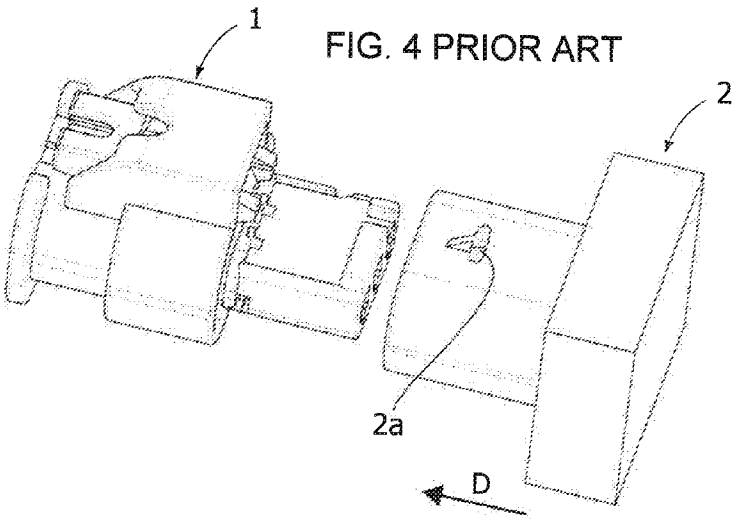
FIG. 4 PRIOR ART
FIG. 4 is a perspective view of the first connection member and a corresponding second connector member having a stop element, prior to being mated together.
Figure 6:
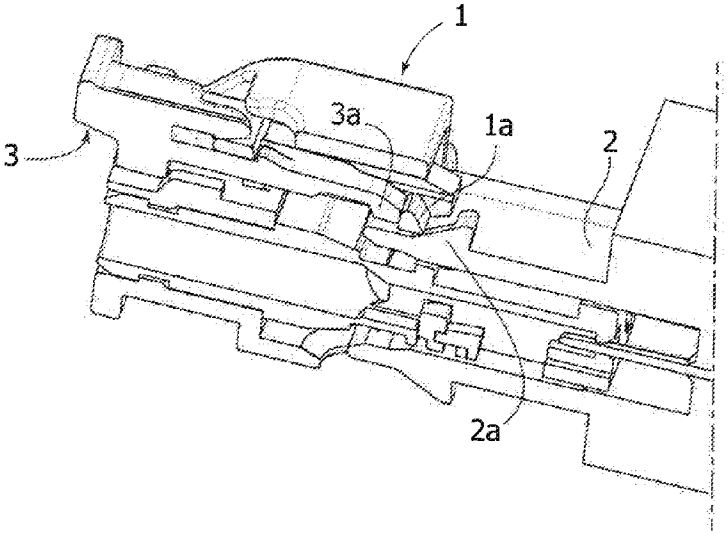
FIG. 6 PRIOR ART
FIG. 6 is a cross-sectional view of the first connection member and second connector member of FIG. 5, with the conventional connector position assurance element.
Figure 7:
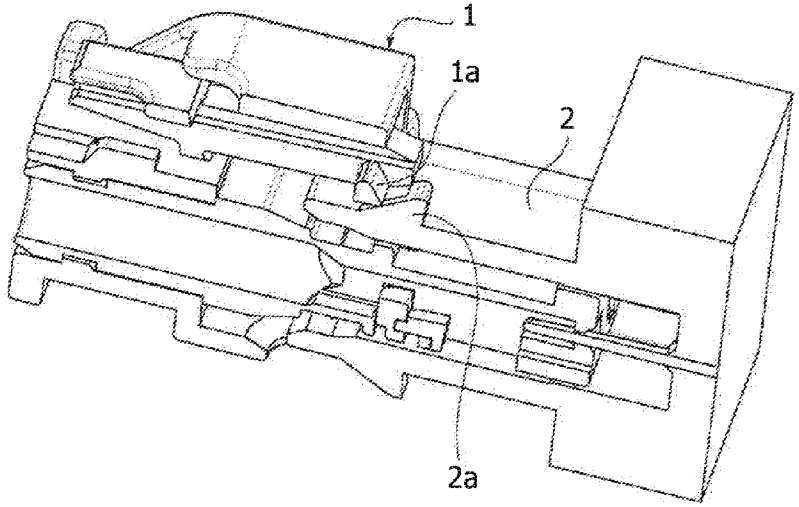
FIG. 7 PRIOR ART
FIG. 7 is a cross-sectional view of the first connector member and second connector member in a preliminary mating phase.
Figure 8:
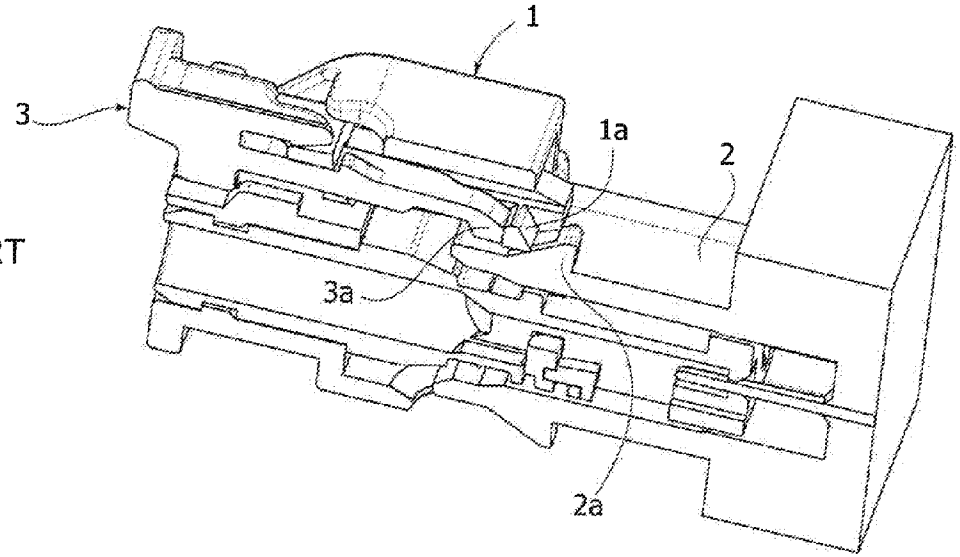
FIG. 8 PRIOR ART
FIG. 8 is a cross-sectional view of the first connector member and second connector member in the preliminary mating phase, with the conventional connector position assurance element.
Figure 9:
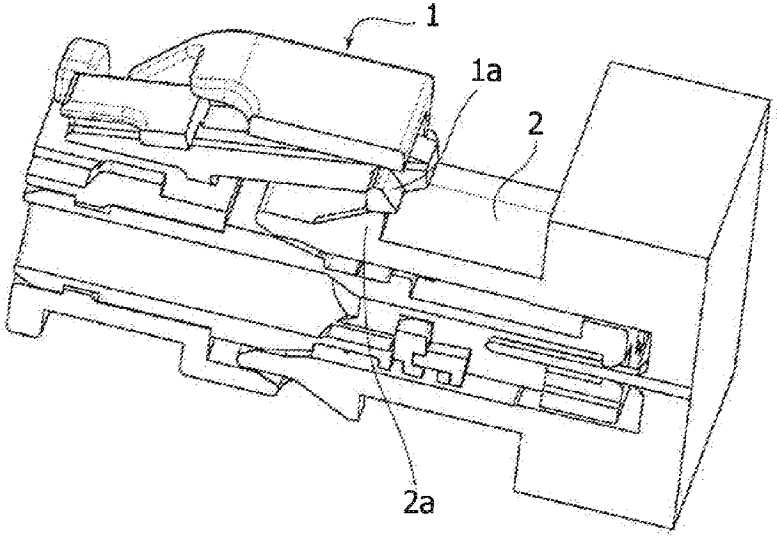
FIG. 9 PRIOR ART
FIG. 9 is a cross-sectional view of the first connector member and the second connector member in an intermediate mating phase.
Figure 10:
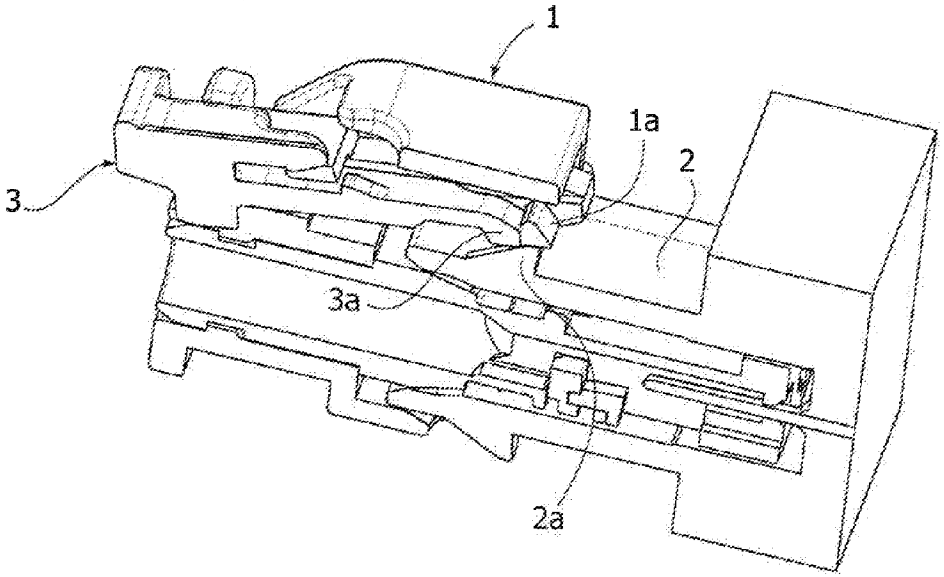
FIG. 10 PRIOR ART
FIG. 10 is a cross-sectional view of the first connector member and the second connector member in the intermediate mating phase, with the conventional position assurance element.
Figure 11:
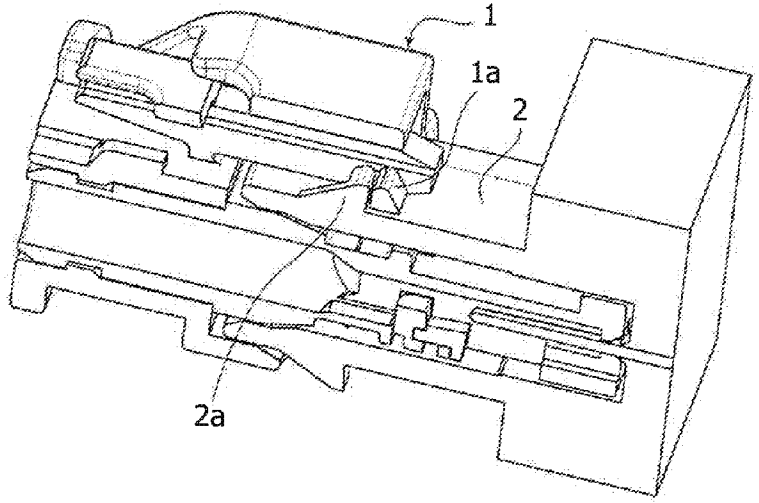
FIG. 11 PRIOR ART
FIG. 11 is a cross-sectional view of the first connector member mated to the second connector member.
Figure 12:
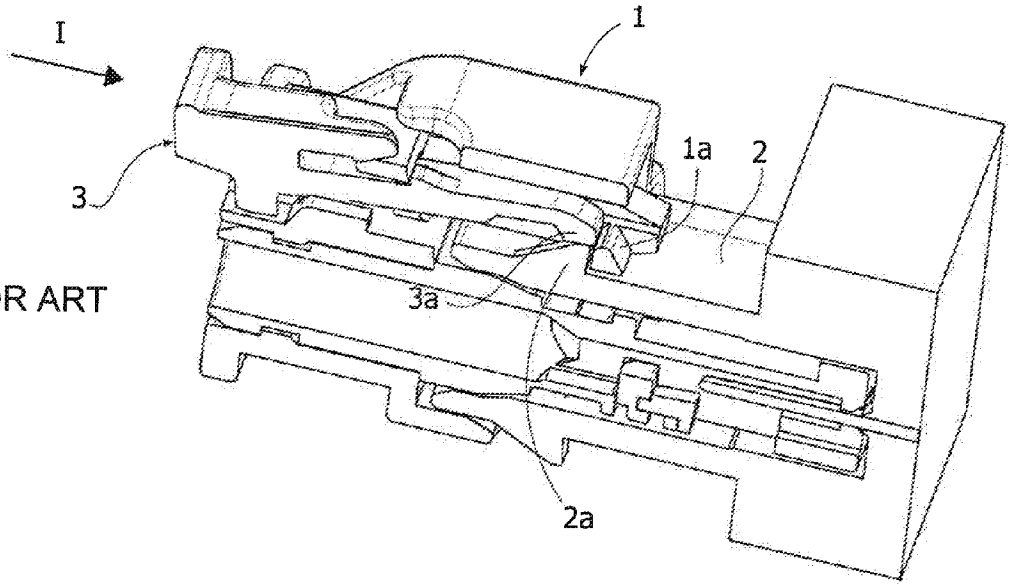
FIG. 12 PRIOR ART
FIG. 12 is a cross-sectional view of the conventional first connector member mated to the second connector member, with the conventional position assurance element in an intermediate mating position.
Figure 13:
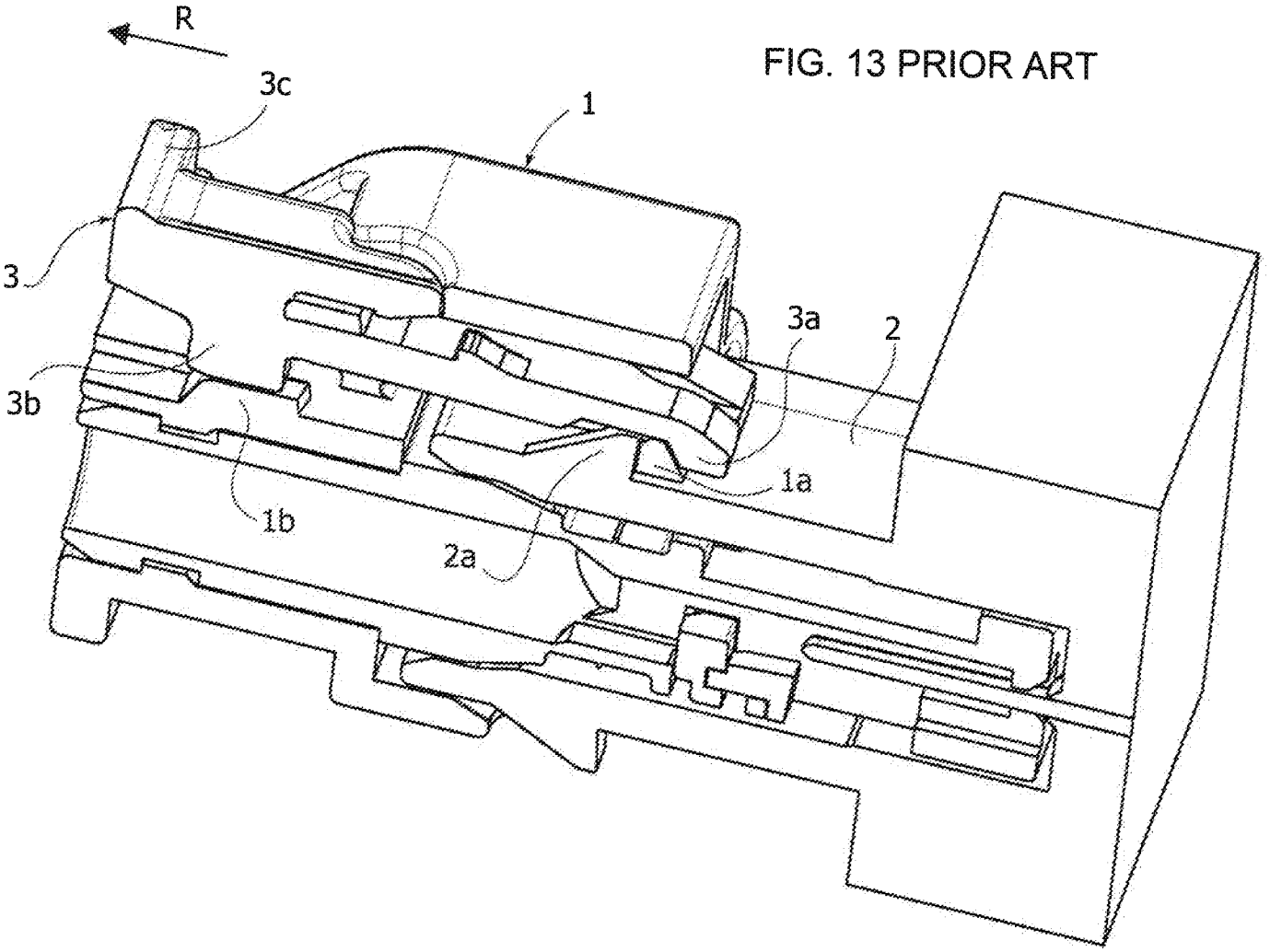
FIG. 13 PRIOR ART
FIG. 13 is a cross-sectional view of the first connector member mated to the second connector member, with the conventional position assurance element in a final mating position.
Figure 14:
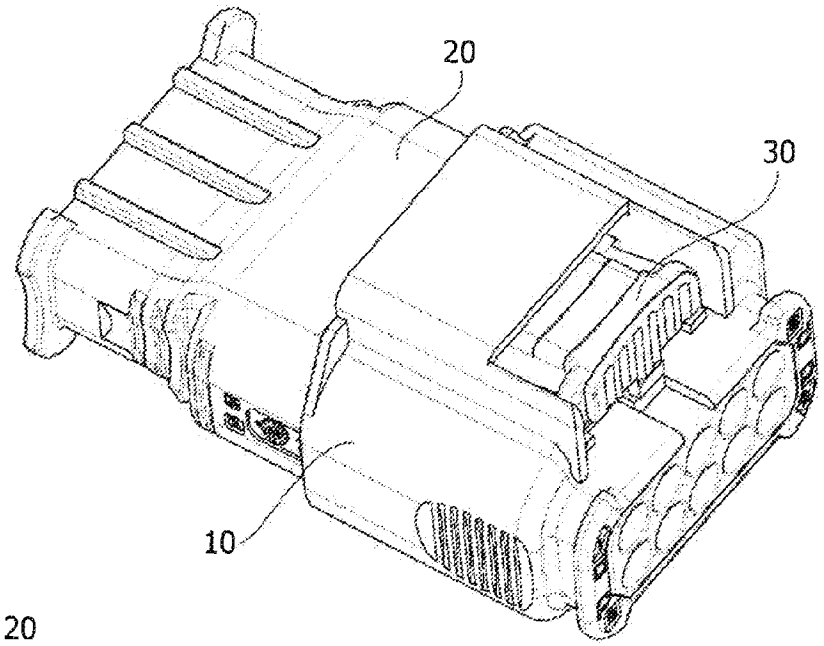
FIG. 14 is a perspective view of a first end of the first connector member and a second connector member in a final mating state, with a first position assurance element in a final mating position.
Figure 15:
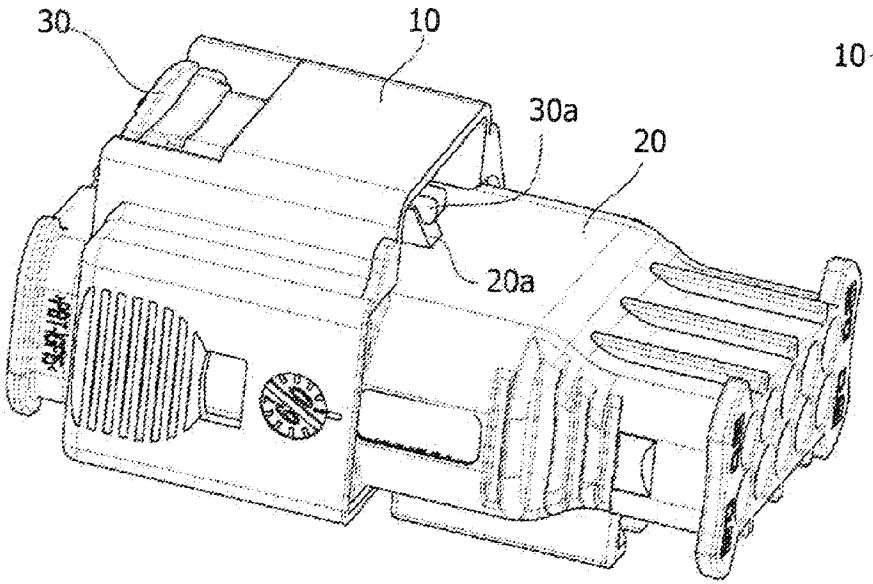
FIG. 15 is a perspective view of a second end of a first connector member and a second connector member in a final mating state, with the first position assurance element in a final mating position.

In the embodiments shown in FIGS. 14 and 15, a first connector member 10 is fully coupled to a corresponding second connector member 20, and a connector position assurance element 30 ("CPA element") is in a second, final mating position.

Figure 16:
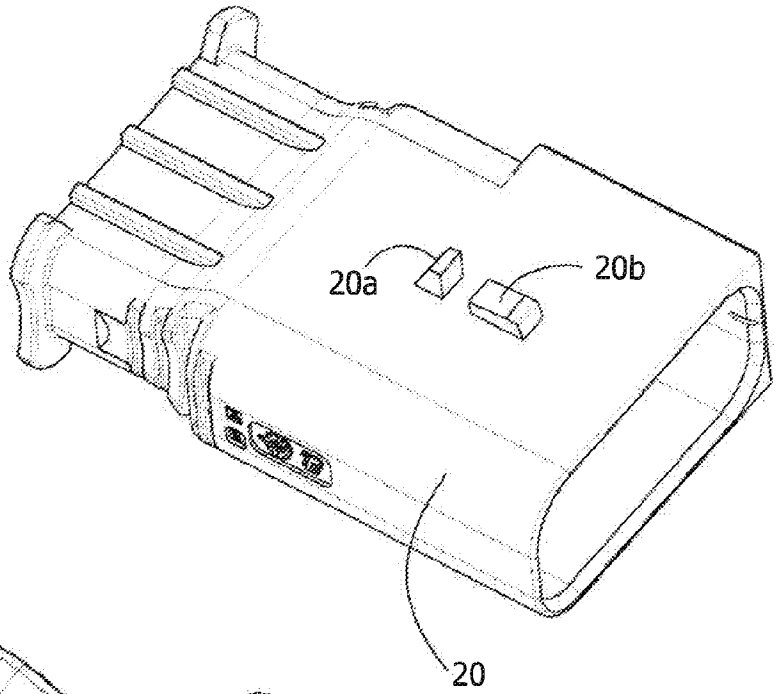
FIG. 16 is a perspective view of a first side of the second connector member.
Figure 17:
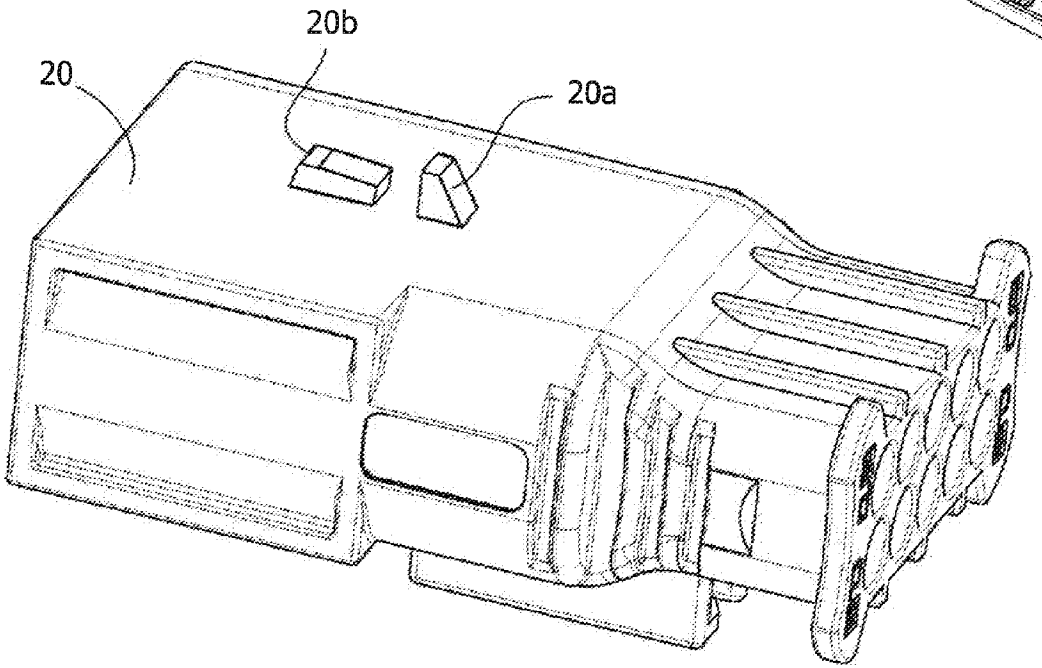
FIG. 17 is a perspective view of a second side of the second connector member.

In the embodiments shown in FIGS. 16 and 17, the second connector member 20 has a second connector body 20 having a stopping element that includes a first raised portion 20*a* and a second raised portion 20*b* positioned on an outer surface of the second connector body 20. The first and second raised portions 20*a*, 20*b* interact with the CPA element 30 in successive moments during the coupling operation between the first and second connector members 10, 20.

Figure 18B:
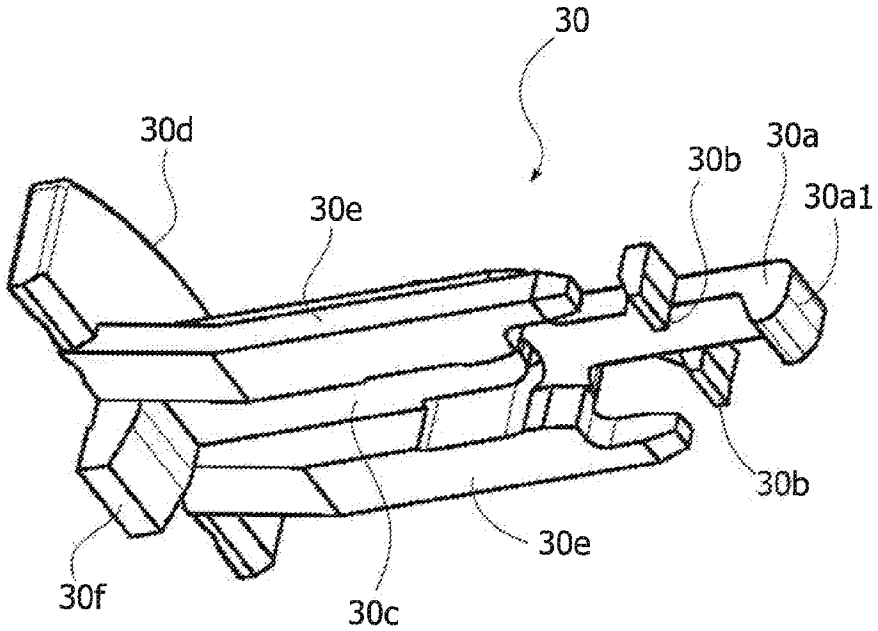
FIG. 18(*a*) is a perspective view of a top side of the first connector position assurance element.
Figure 18A:
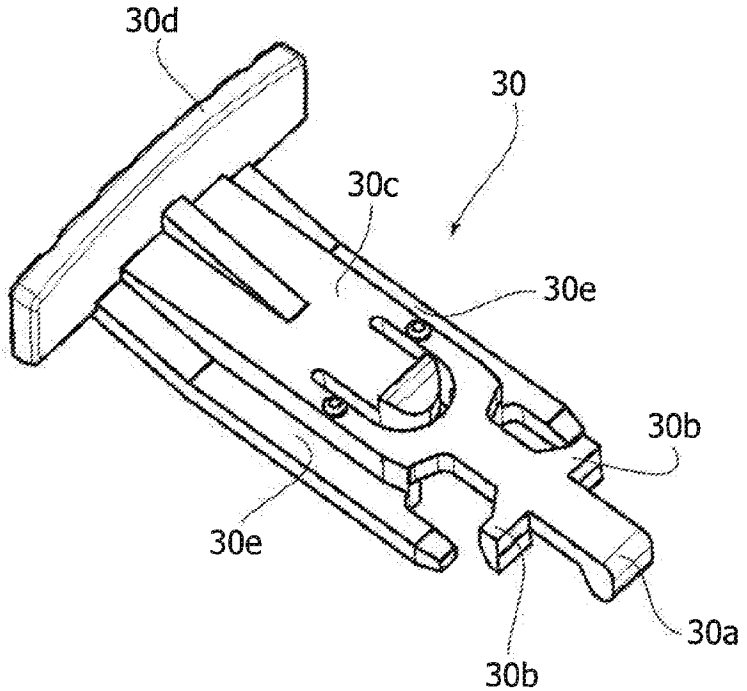

In the embodiments shown in FIGS. 18*a* and 18*b*, the connector position assurance element 30 has a first engagement portion formed by two engaging projections 30*b*, 30*b* and a second engagement portion formed by a ramp-like latching arm 30*a*. The first and second engagement portions 30*a* and 30*b* are spaced from each other in a longitudinal direction of the connector position assurance element 30 and cooperate respectively, the engaging projections 30*b* with the stop surface of the first connector member 10 in the first, preliminary mounting position and the latching arm 30*a* with the stop element 20 of the second connector member in the second, final position. As such, when the first and second connector members 10, 20 are coupled together correctly, the connector position assurance element 30 can be displaced to bring it into the final position.

The connector position assurance element 30 comprises a body having a grasping member 30*d* and a longitudinally extending arm 30*c* extending from the grasping member 30*d*. The first 30*b* and second 30*a* engagement portions are positioned on the free end of the longitudinal arm 30*c*, extending therefrom.

At a terminating end portion of the free end of the longitudinal arm 30*c* of the position assurance element 30, the second engagement portion 30*a* has an inner surface with a ramp-like latching projection 30*a*1 extending outward.

Furthermore, the longitudinal arm 30*c* of the position assurance element 30 has, in a position set back from the ramp-like latching projection 30*a*1, two engaging projections 30*b* which extend radially and form the aforesaid first engagement portion.

Figure 19A:
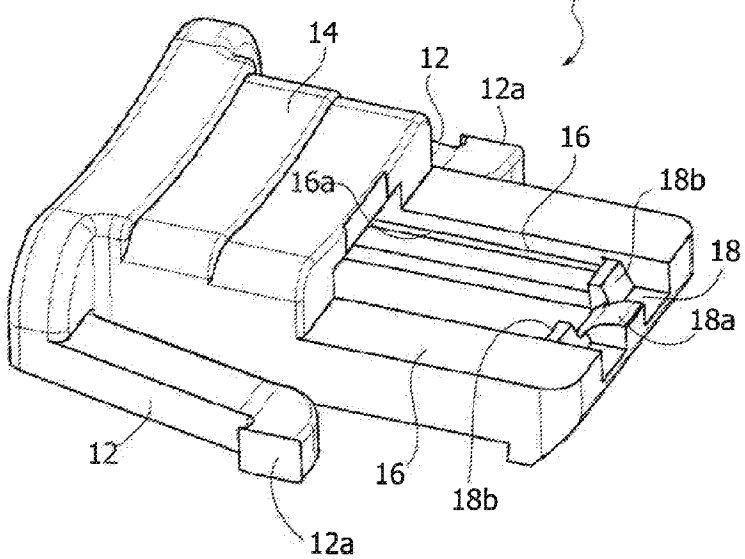
FIG. 19(*a*) is a perspective view of a top side of a CPA receiving member of the first connector member.
Figure 19B:
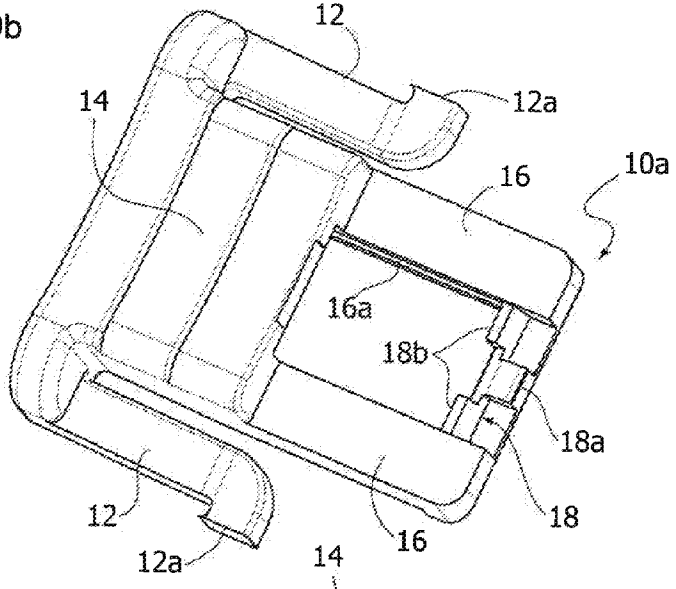
Figure 19C:
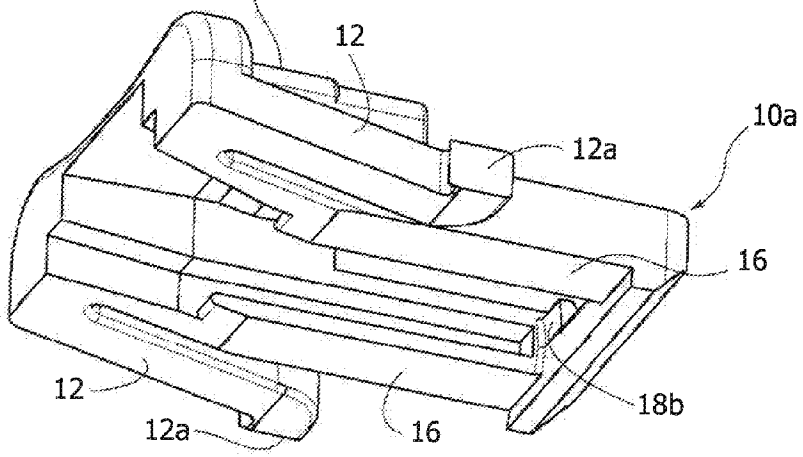

The longitudinal arm 30*c* of the position assurance element 30 further comprises two longitudinal guide ribs 30*e* suitable for engaging with two corresponding guide receiving grooves 16*a* disposed in the first connector member 10 (see FIG. 19), so as to facilitate the sliding of the position assurance element 30 in the first connector member 10.

The first connector member 10 has a connector position assurance receiving member 10*a* ("CPA receiving member"; see FIGS. 19*a*, 19*b*, 19*c* and 20) connected flexibly to the main body 10 of the first connector member by two cantilevered receiving member arms 12. The CPA receiving member 10*a* is connected to the body 10 via the free end 12*a* of the receiving member arms 12, which act as hinges and allow the whole CPA receiving member 10*a* to flex around these connection points.

The CPA receiving member 10*a* has a rear bridging portion 14 suitable for receiving the connector position assurance element 30, a central portion defined by two longitudinally extending receiving member bodies 16 which face each other, each receiving member body 16 having a free end position distal to the rear bridging portion 14, and a transverse front bridging portion 18. The receiving member bodies 16 are spaced apart a distance and the guide receiving grooves 16*a* are formed on inner surfaces of the receiving member bodies 16 facing each other. The front bridging portion 18 extends between the free ends of the receiving member bodies 16. The front bridging portion 18 functions as the stop surface 1*a* introduced in the description of the known art, against which the two engaging projections 30*b* are engaged.

Figure 20A:
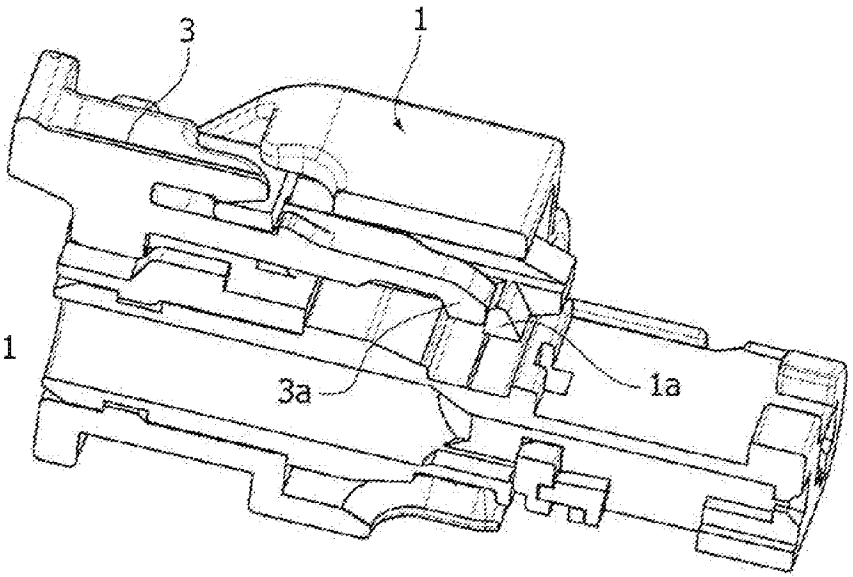
FIG 20a PRIOR ART
FIG. 20(*a*) is a partial cross-sectional view of the first connector member mated to the second connector member, with the conventional connector position assurance element in the preliminary mating position.
Figure 20B:
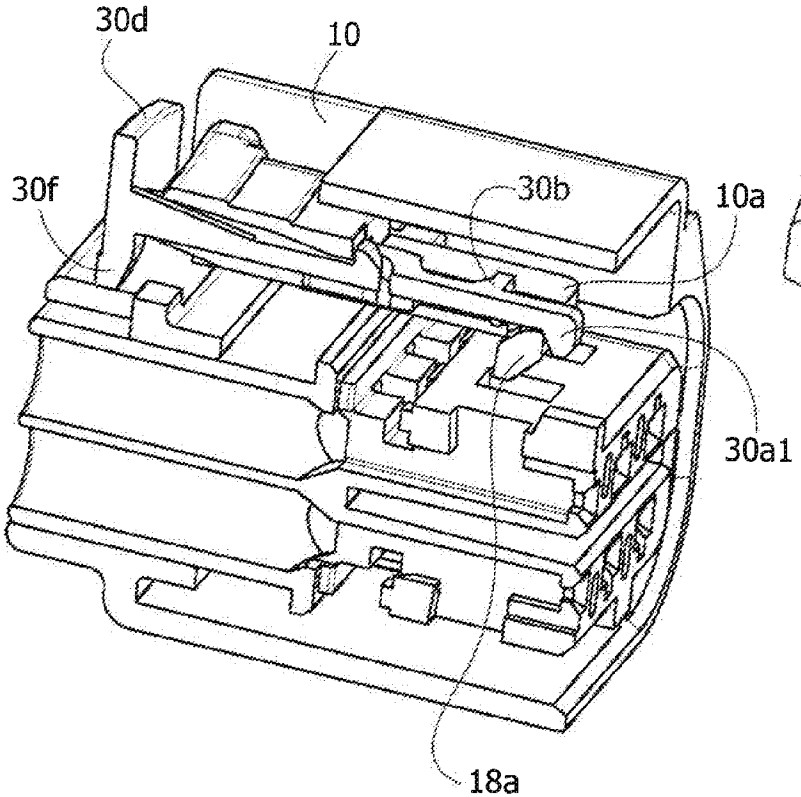

In greater detail, the transverse front bridging portion 18 has an upper surface with a protruding central projection 18*a* and two flanking projection 18*b*. The flanking projection 18*b* is offset from the central projection 18*a* towards the rear bridging portion 14. When the position assurance element 30 is in the first, preliminary mounting position, the flanking projections 18*b* perform the function of the conventional stop surface 1*a* in FIG. 20*a*, against which the two engaging projections 30*b* of the connector position assurance element 30 abut. Again in the first, preliminary mounting position (see FIG. 20*b*), the ramp-like latching projection 30*a*1, which forms the second engagement portion of the connector position assurance element 30, is positioned beyond the central projection 18*a*. The conventional approach in FIG. 20*a* is compared to the current solution in FIG. 20*b*, where both the connector position assurance elements 3, 30 are in the first, preliminary mounting position. In FIG. 20*a*, the engagement portion 3*a* of the conventional connector position assurance element 3 is in contact with the stop surface 1*a* of the first connector member 1, and is thus prevented from moving further. In contrast, in the embodiment shown in FIG. 20*b*, the latching projection 30*a*1 is positioned beyond the central projection 18*a*, because the locking function to prevent the CPA element 30 from moving beyond its preliminary mounting position is no longer performed by latching projection 30*a*1. Instead, the locking function is performed by the first engagement portion formed by the two engaging projections 30*b*, which, as is more clearly illustrated in FIG. 21, are engaged against the flanking projections 18*b* of the transverse front bridging portion 18 of the CPA receiving member 10*a* of the first connector member 10.

Figure 21B:
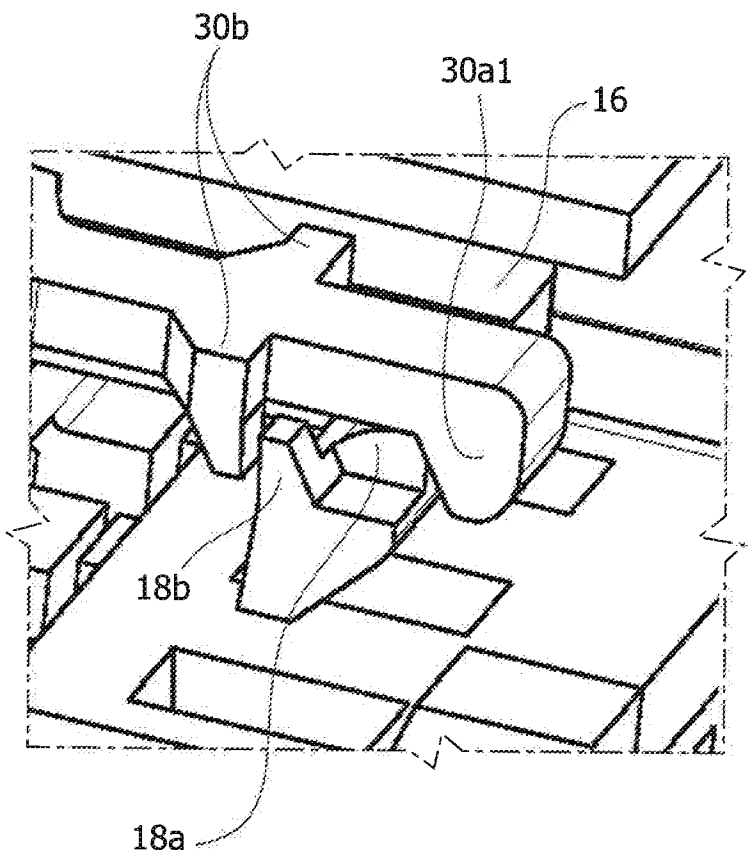
FIG. 21(*a*) is a partial cross-sectional view of the first connector member with the first connector position assurance element.
Figure 21A:
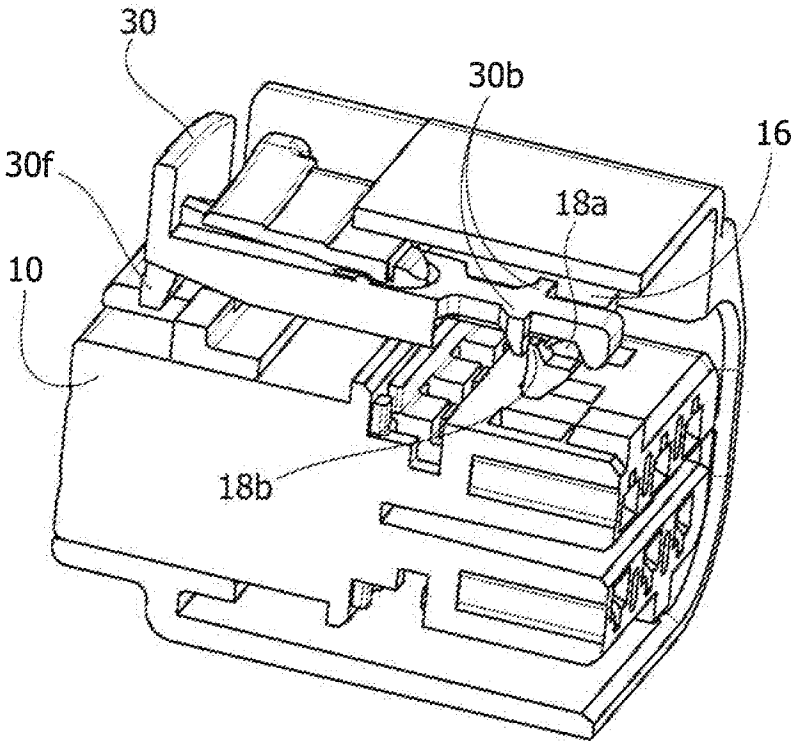
Figure 22B:
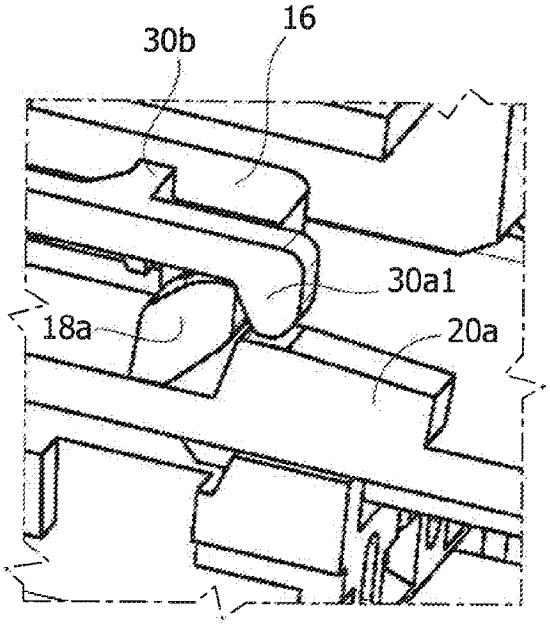
FIG. 22(*a*) is a cross-sectional view of the first connector member prior to being mated to the second connector member, with the first connector position assurance element in a preliminary mating position.
Figure 22A:
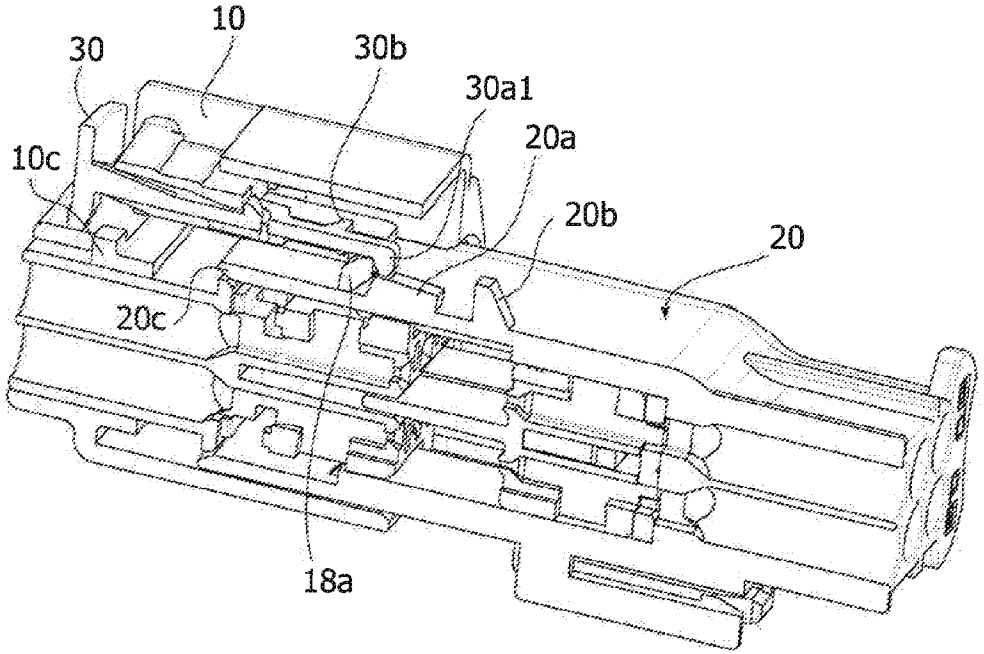

FIG. 21*a* thus shows the first connector member with the CPA element 30 in the preliminary mounting position, and FIG. 21*b* is an enlargement of the previous figure, showing that the CPA element 30 is prevented from advancing further beyond the stop surface defined by the flanking projection 18*b*.

Figure 23:
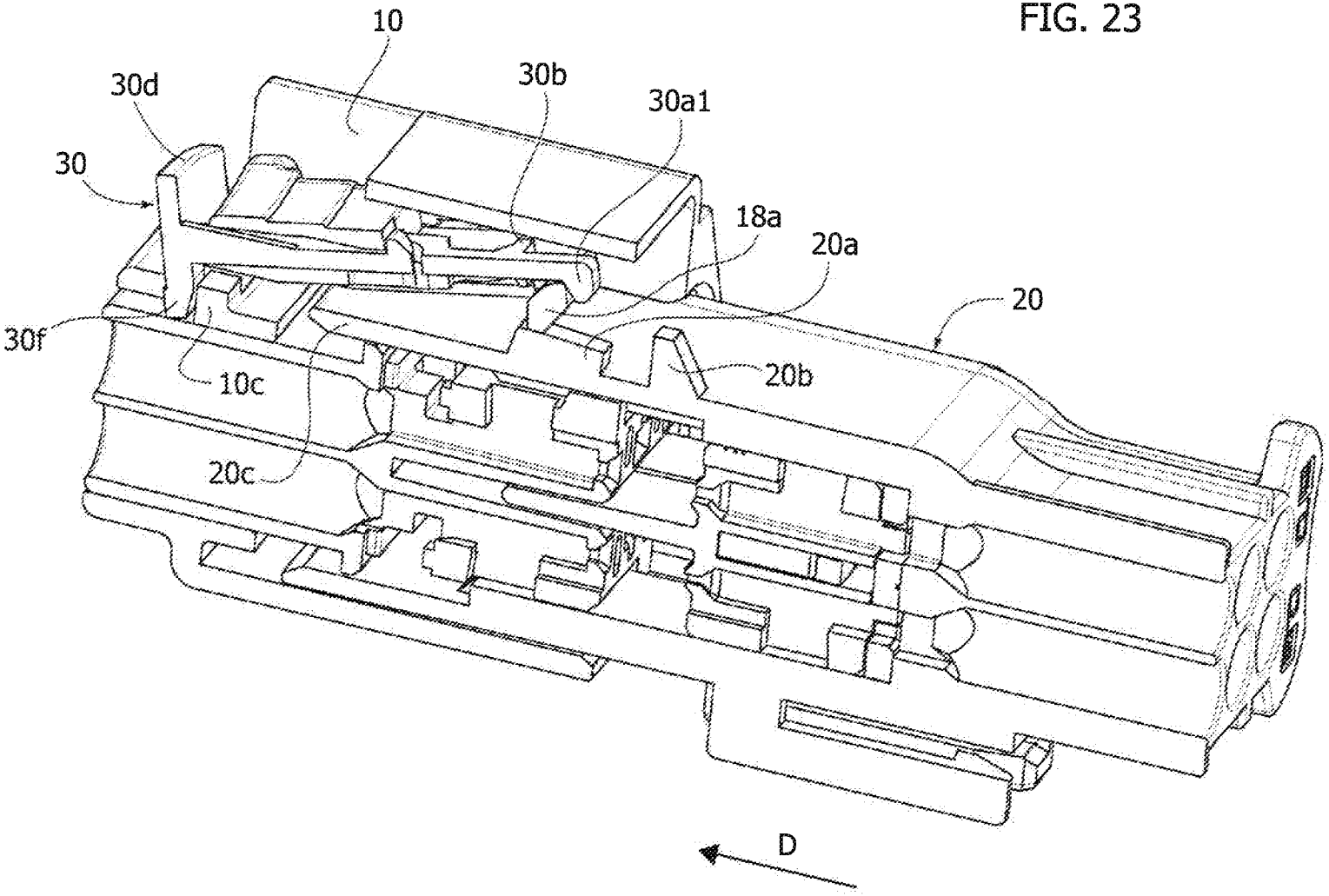
FIG. 23 is a cross-sectional view of the first connector member partially mated to the second connector member, being in a first intermediate mating state, where the first connector position assurance element is in a first intermediate mating position.
Figure 24:
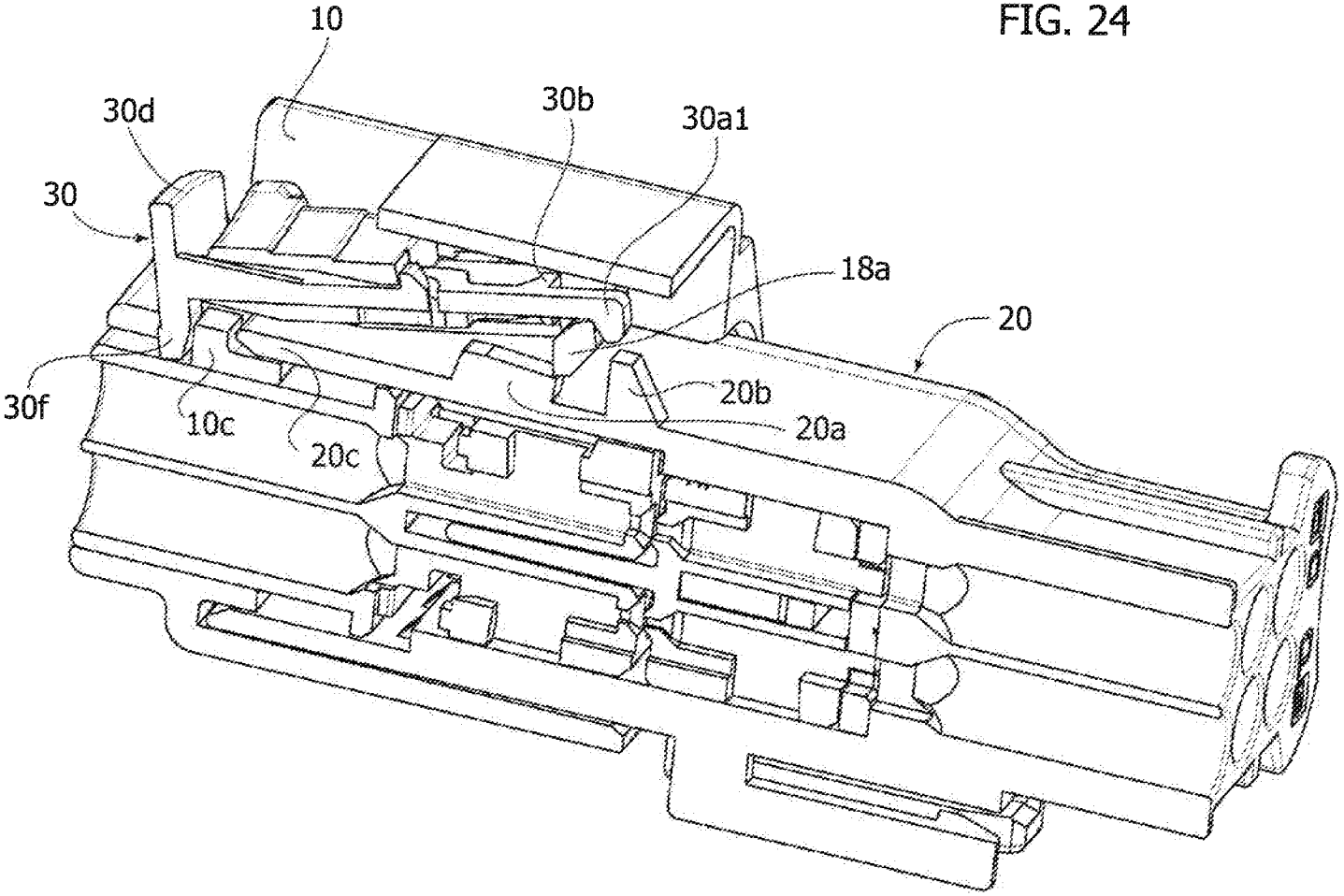
FIG. 24 is a cross-sectional view of the first connector member partially mated to the second connector member, being in a second intermediate mating state, where the first connector position assurance element is in a second intermediate mating position.
Figure 25:
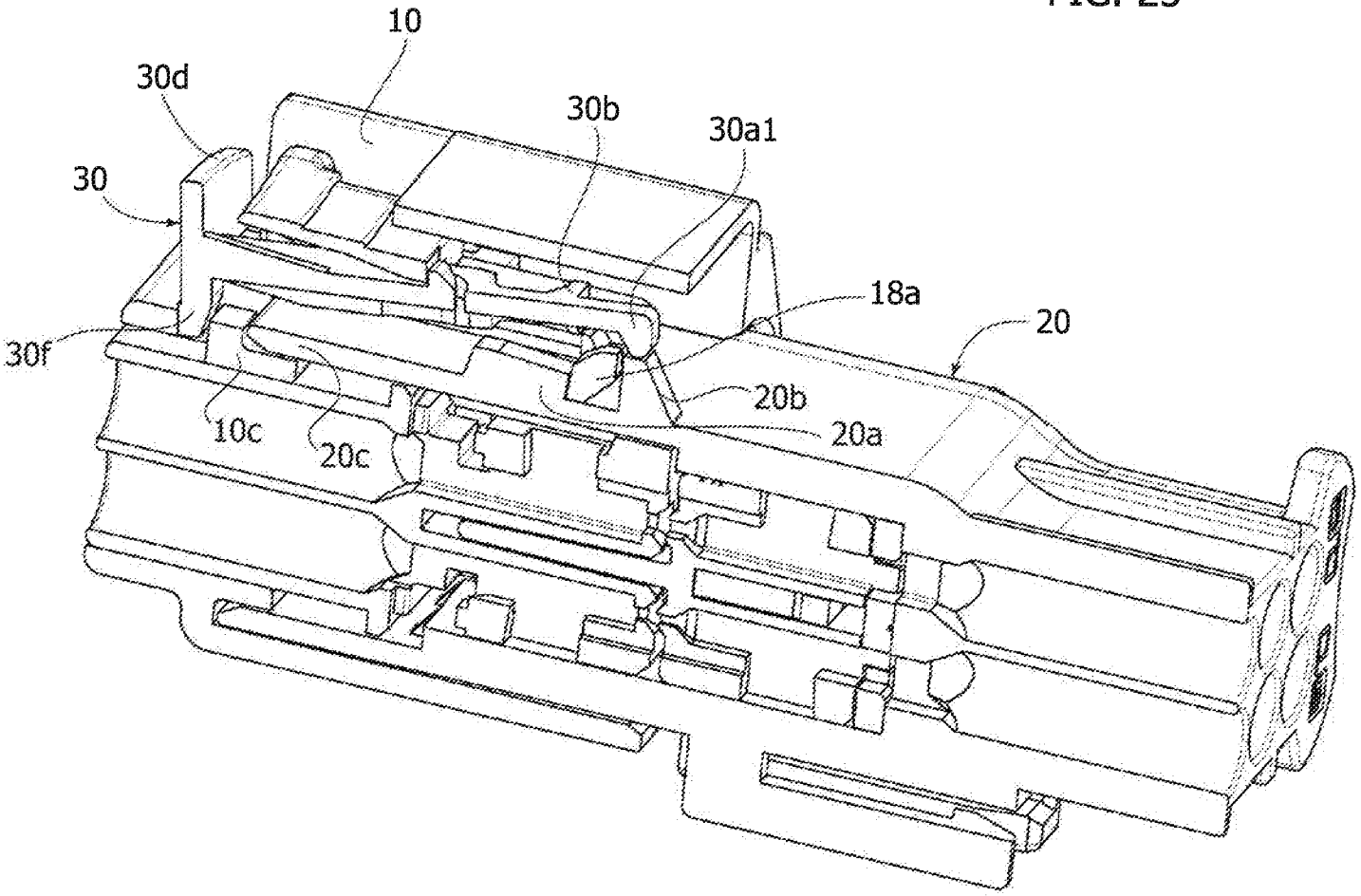
FIG. 25 is a cross-sectional view of the first connector member partially mated to the second connector member, being in a third intermediate mating state, where the first connector position assurance element is in a third intermediate mating position.

In the embodiments shown in FIGS. 23, 24 and 25, a first intermediate mating position, a second intermediate mating position, and a third intermediate mating position, respectively, are shown of the coupling process of the two connector members 10 and 20. During these intermediate mating positions, when the second connection member 20 is inserted into the first connection member 10, the first raised portion 20*a* positioned on the outer surface the second connector member 20 contacts the front bridging portion 18 of the CPA receiving member 10*a*, displacing the front bridging portion 18 of the first connector member 10, and the free end 30*a*1 of the longitudinal arm 30*c* of the position assurance element 30 in an outward direction away from the first connection member 10. (See FIGS. 23 and 24) The second raised portion 20*b* of the second connector member 20, positioned a distance from the first raised portion 20*a* in the direction of insertion D, maintains the position of the outwardly displaced latching projection 30*a*1 of the longitudinal arm 30*c* while the front bridging portion 18 is lowered and engaged in the space between the first and second raised portions 20*a*, 20*b*. (See FIG. 25) Thus, the engaging projections 30*b* are permitted to disengage from the flanking projection 18*b*, allowing the connector position assurance element 30 to be capable of being pushed from the first, preliminary mounting position to the second, final mating position shown in the embodiments of FIGS. 27 and 28.

Figure 26:
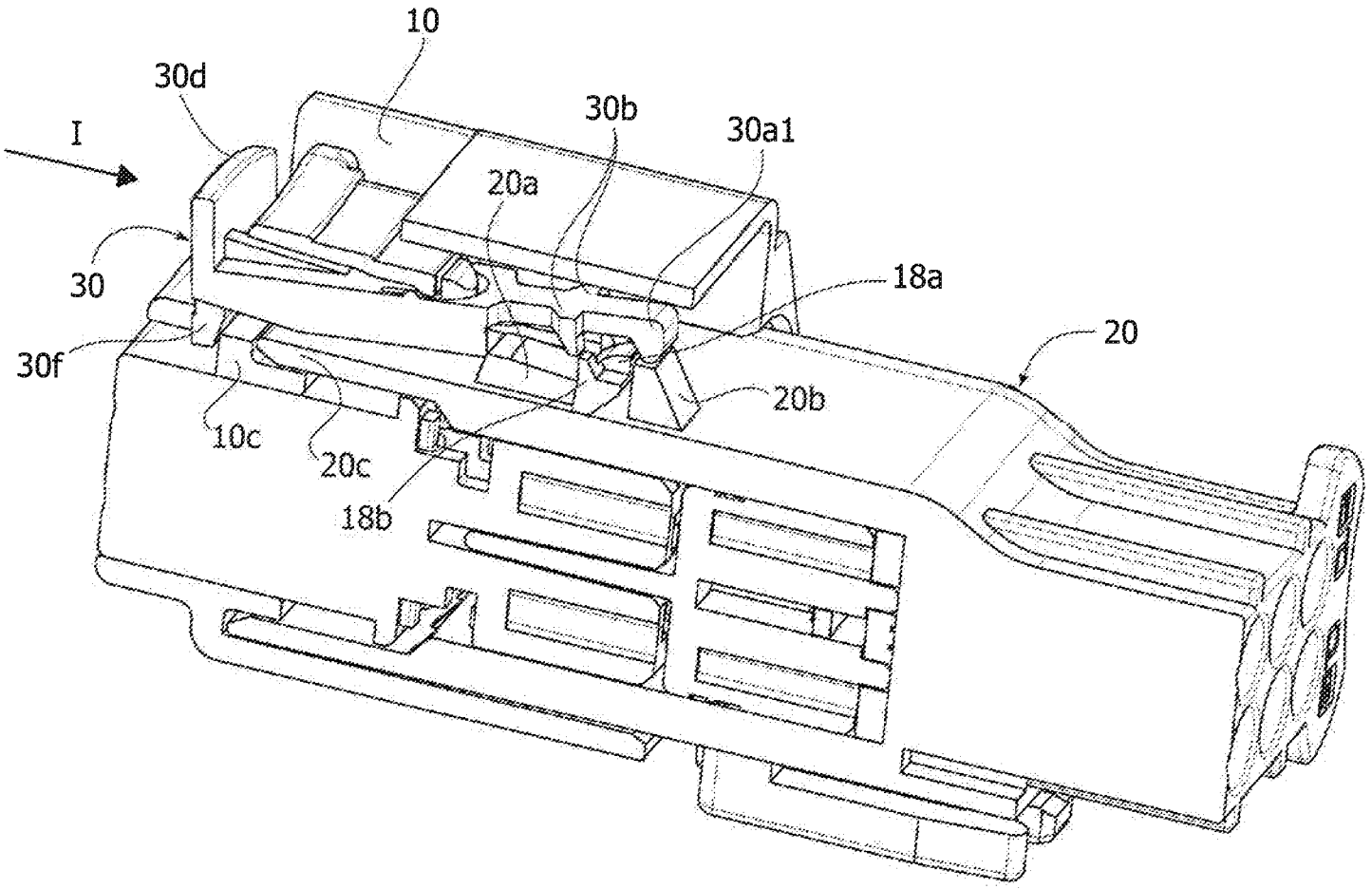
FIG. 26 is another cross-sectional view of the first connector member partially mated to the second connector member, being in a third intermediate mating state, where the first connector position assurance element is in a third intermediate mating position.

In an embodiment shown in FIG. 26, the two connector members 10 and 20 have the connection position assurance element 30 in the third intermediate mating position, ready to be pushed into the final mating position. Comparing the embodiments shown in FIGS. 22 to 26, a front edge 20*c* of the second connector member 20 is advanced in the direction of insertion D until the front edge 20*c* abuts against an abutment wall 10*c* disposed on the first connector member 10.

Figure 27:
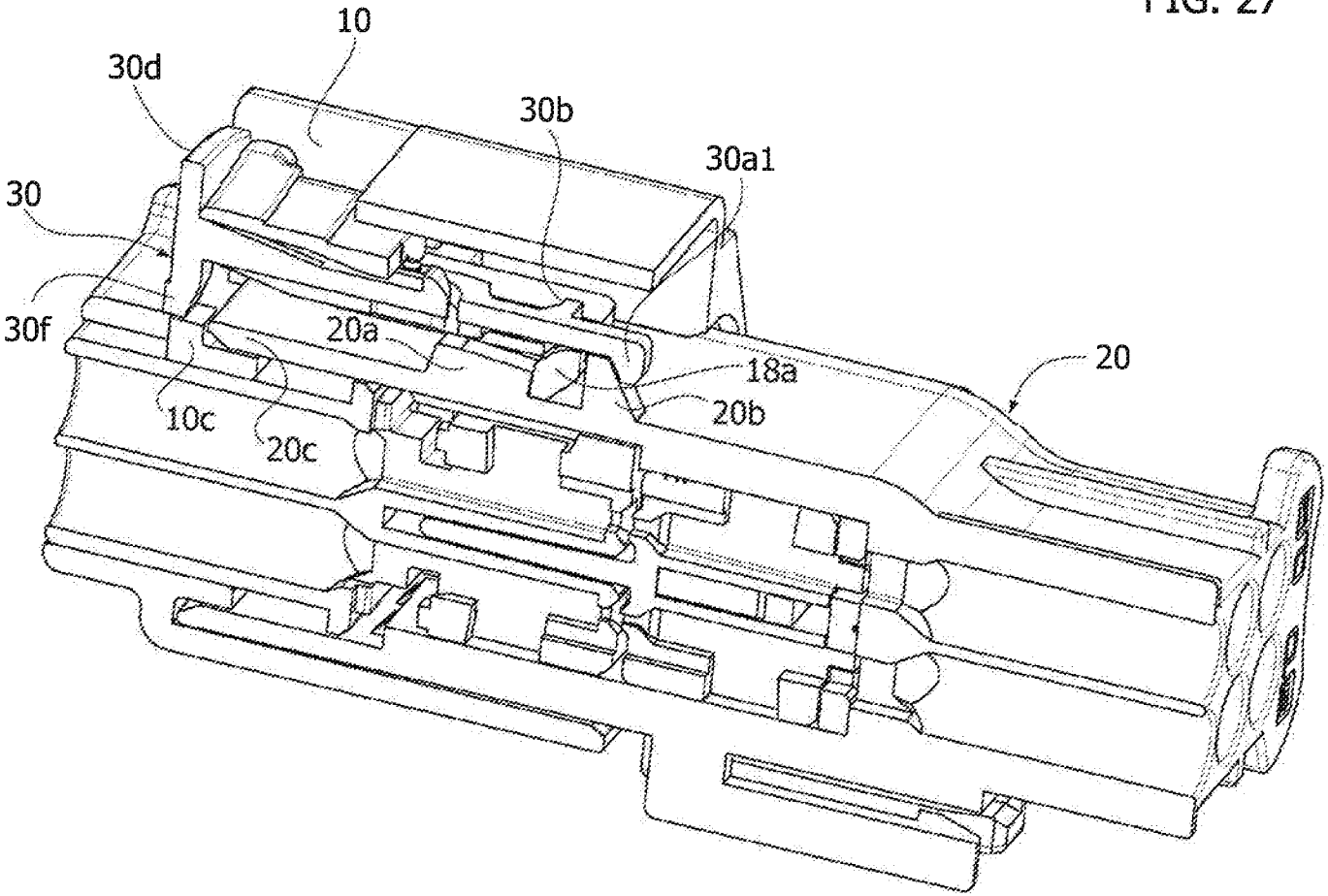
FIG. 27 is a cross-sectional view of the first connector member fully mated to the second connector member, being in a final mating state, where the first connector position assurance element is in a final mating position.
Figure 28:
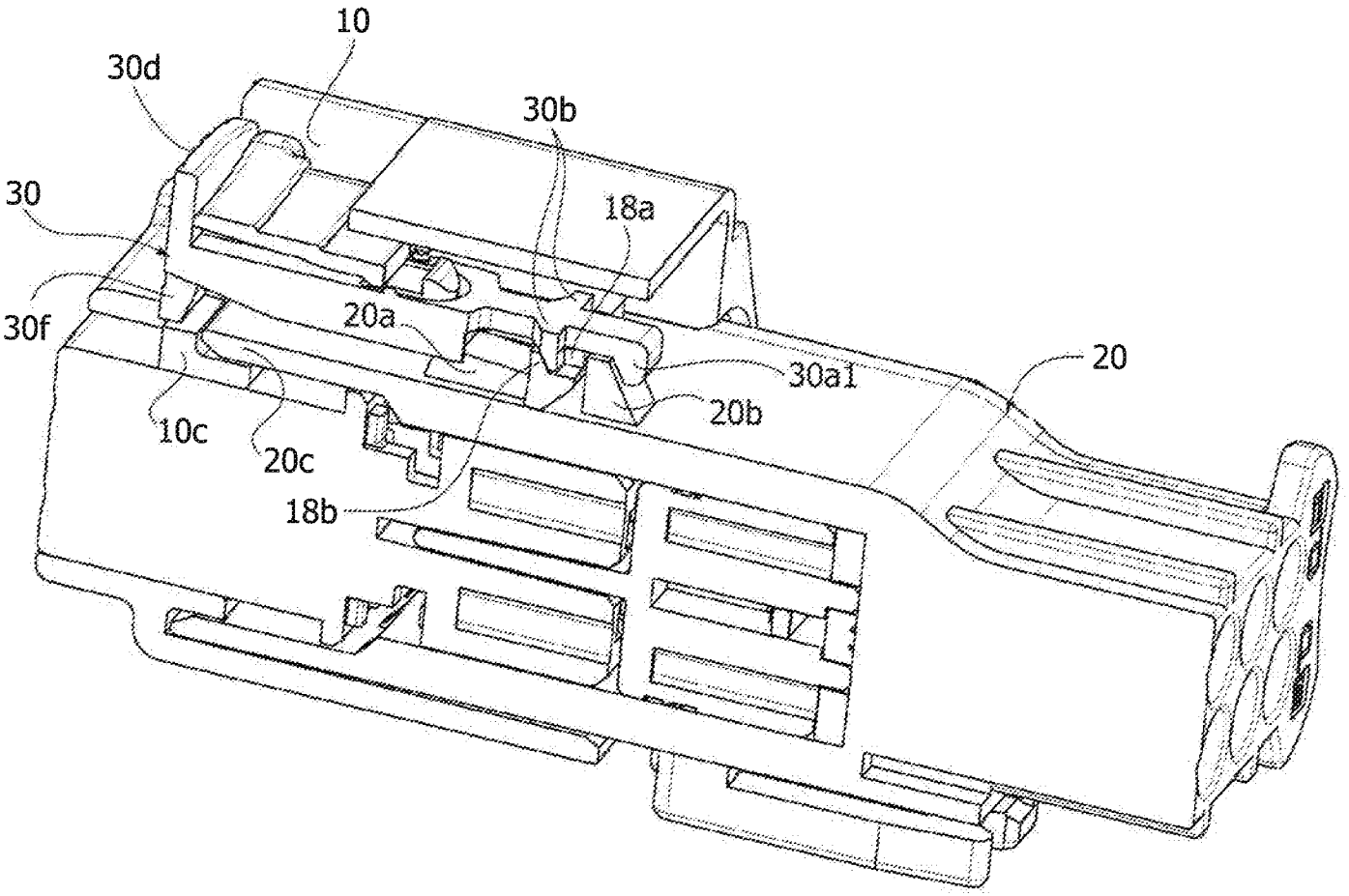
FIG. 28 is another cross-sectional view of the first connector member fully mated to the second connector member, being in a final mating state, where the first connector position assurance element is in a final mating position.

In an embodiment shown in FIG. 27, connector position assurance element 30 is in the final mating position, in which the ramp-like latching projection 30*a*1, forming the second engagement portion of the connector position assurance element 30, has been advanced beyond the second raised portion 20*b*, and is engaged thereto.

In the embodiments of FIGS. 18(*b*) and 28, the grasping member 30*d* of the connector position assurance element 30 has a securing tongue 30*f* protruding outward and in the opposite direction from the grasping member 30*d*. The abutment wall 10*c* on the first connector member 10 is complimentary to the securing tongue 30*f*, wherein, in the final mating position of the position assurance element 30, a portion of the abutment wall 10*c* engages with the securing tongue 30*f* to lock the position assurance element 30 in position.

Again with reference to FIG. 28, in the final mating position of the connector position assurance element 30, the two side engaging projections 30*b* are positioned along to the front bridging portion 18, past the flanking projections 18*b*. Further, the two engaging projections 30*b* are engaged with the flanking projections 18*b* to prevent the connector position assurance element 30 from being removed from the CPA receiving member 10*a*.

Although numerous exemplary embodiments have been shown and described, those of ordinary skill in the art would appreciate that various changes or modifications may be made in these embodiments without departing from the principles and spirit of the disclosure, the scope of which is defined in the claims and their equivalents.

What is claimed is:

1. An electrical connector comprising:

a first connector member having a stop surface with flanking projections; and a second connector member complimentary to the first connector member and having a stop element with a second raised portion; and a connector position assurance element slidably mountable on the first connector member, having a first engagement portion that engages the flanking projections when the first connector member is completely mated to the second connector member in a final mating position, and a second engagement portion spaced a distance from the first engagement portion in a longitudinal direction of the connector position assurance element, being engaged with the second raised portion when the first connector member is mated to the second connector member in the final mating position.

2. The electrical connector according to claim 1, wherein when the first connector member is partially mated to the second connector member in a preliminary mounting position, the connector position assurance element abuts a surface of the flanking projections to prevent any inward movement of the connector position assurance element.

3. The electrical connector according to claim 1, wherein the connector position assurance element includes:

a grasping member; and a cantilevered arm portion extending longitudinally outward from the grasping member.

4. The electrical connector according to claim 3, wherein the first engagement portion and the second engagement portion are positioned on a free end of the cantilevered arm portion.

5. The electrical connector according to claim 4, wherein the second engagement portion has an inner surface with a ramp-like latching projection extending outward from a terminating end portion of the free end of the longitudinal arm.

6. The electrical connector according to claim 5, wherein the first engagement portion has two engaging projections extending outward in a direction perpendicular to the latching projection, the two engaging projections spaced a distance from the latching projection in the longitudinal direction towards the grasping member.

7. The electrical connector according to claim 6, wherein the longitudinal arm of the position assurance element further comprises two longitudinal guide ribs that engage with two corresponding guide receiving grooves disposed in the first connector member.

8. The electrical connector according to claim 7, further comprising a CPA receiving member flexibly connected to a main body of the first connector member.

9. The electrical connector according to claim 8, wherein the CPA receiving member has a rear bridging portion complimentary to the connector position assurance element such that the connector position assurance element is received through the rear bridging portion.

10. The electrical connector according to claim 9, wherein the CPA receiving member further includes a central portion having two longitudinally extending receiving member bodies spaced a distance apart and facing each other along an inner side surface, each having a free end positioned distal to the rear bridging portion.

11. The electrical connector according to claim 10, wherein the guide receiving grooves are disposed on each of the inner side surfaces of the receiving member bodies.

12. The electrical connector according to claim 11, wherein the CPA receiving member further includes a front bridging portion on an end opposite the rear bridging portion, the front bridging portion connecting the free ends of the receiving member bodies and extending transversely therebetween.

13. The electrical connector according to claim 12, wherein the stop surface of the first connector member includes the front bridging portion, with the flanking projections being positioned on the front bridging portion.

14. The electrical connector according to claim 13, wherein the front bridging portion has an outward facing surface onto which a protruding central projection and two of the flanking projections are positioned, the two flanking projections being positioned offset from the protruding central projection towards the rear bridging portion.

15. The electrical connector according to claim 14, wherein when the connector position assurance element is in the preliminary mounting position, the two engaging projections of the connector position assurance element abut against a grasping member facing surface of the two flanking projections, and the central projection is positioned a distance from a grasping member facing end of the ramp-like latching projection.

16. The electrical connector according to claim 15, wherein the second connector member further comprises a first raised portion positioned on a central portion of an outer facing surface.

17. The electrical connector according to claim 16, wherein when the second connector member is mated to the first connector member, the front bridging portion and the free end of the latching arm of the position assurance element are displaced outward by the first raised portion from a resting position.

18. The electrical connector according to claim 17, wherein the second raised portion is positioned a distance from the first raised portion.

19. The electrical connector according to claim 18, wherein when the connector position assurance element is in an intermediate mating position between the preliminary mating position and the final mating position, the free end of the latching arm is displaced by the second raised portion, while the front bridging portion is the resting position and engaged between the first and second raised portions.

20. The electrical connector according to claim 19, wherein when the connector position assurance element is in the intermediate mating position, engaging projections are disengaged from the flanking projection.

21. The electrical connector according to claim 20, wherein the grasping member of the connection position assurance element has a securing tongue protruding outward from the grasping member in an opposite direction.

22. The electrical connector according to claim 21, wherein the first connector member further comprises an abutment wall.

23. The electrical connector according to claim 22, wherein when the connector position assurance element is in the final mating position, the abutment wall is engage with the securing tongue to lock the connector position assurance element in the final mating position.

* * * * *